US006652380B1

(12) United States Patent
Luciano

(10) Patent No.: US 6,652,380 B1
(45) **Date of Patent: *Nov. 25, 2003**

(54) CASHLESS GAMING SYSTEM AND METHOD

(75) Inventor: Robert A. Luciano, Reno, NV (US)

(73) Assignee: Sierra Design Group, Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/454,903

(22) Filed: Dec. 3, 1999

Related U.S. Application Data

(60) Provisional application No. 60/111,062, filed on Dec. 4, 1998.

(51) Int. Cl.[7] ..... A63F 9/24

(52) U.S. Cl. ..... 463/25; 463/43

(58) Field of Search ..... 463/16, 17, 18, 463/19, 25, 29, 42, 43; 235/379, 380, 381; 902/23; 221/10, 97; 705/14, 16, 24, 40; 273/138.2, 139

(56) References Cited

U.S. PATENT DOCUMENTS

| | | | | |
|---|---|---|---|---|
| 5,010,485 A | * | 4/1991 | Bigari | 364/408 |
| 5,265,874 A | | 11/1993 | Dickinson et al. | |
| 5,290,033 A | | 3/1994 | Bittner et al. | |
| 5,655,966 A | * | 8/1997 | Werdin, Jr. et al. | 463/25 |
| 5,953,709 A | * | 9/1999 | Gilbert et al. | 705/35 |
| 6,012,832 A | | 1/2000 | Saunders et al. | |
| 6,047,807 A | * | 4/2000 | Molbak | 194/217 |
| 6,048,269 A | * | 4/2000 | Burns et al. | 463/25 |
| 6,089,982 A | * | 7/2000 | Holch et al. | 463/42 |
| 6,230,928 B1 | * | 5/2001 | Hanna et al. | 221/13 |
| 6,280,326 B1 | * | 8/2001 | Saunders | 463/25 |

FOREIGN PATENT DOCUMENTS

| | | |
|---|---|---|
| WO | WO 94/1678 | 8/1994 |

* cited by examiner

*Primary Examiner*—Kim Nguyen
(74) *Attorney, Agent, or Firm*—Russ F. Marsden

(57) ABSTRACT

The present invention discloses a voucher-based gaming transaction system, wherein vouchers are used for game credits rather than any form of coins or bills. Further disclosed are gaming machines that have the ability to fully transact using vouchers, including the ability to read, write, encrypt, and decrypt vouchers and create unique transaction IDs for each transaction (per voucher). The vouchers are independent of any type of player tracking or player accounts, and are operationally independent of each other. The system further includes a backend computer with a database which uses the unique transaction IDs for storing data associated with each transaction, primarily value and time of issuance information.

12 Claims, 8 Drawing Sheets

Cashless Transaction System

Central Terminal

Player Terminal

Automated Cash Exchange Terminal

Automated Cash Exchange Terminal Shapes

External View
Cash Redemption
Terminal

Block Diagram
Cash Redemption
Terminal

Use Of Automated
Cash Exchange Terminal

Use Of Central
Cash Exchange Terminal

Use Of Automated
Cash Redemption Terminal

Use Of Central
Cash Redemption Terminal

CASHLESS GAMING SYSTEM AND METHOD

CROSS REFERENCE TO RELATED APPLICATIONS

This application claims priority of and incorporates by reference U.S. provisional patent application No. 60/111,062 filed on Dec. 4, 1998.

FIELD OF THE INVENTION

The present invention relates to a system and method for playing games of chance. More particularly, the present inventions relates to a system and method for playing games of chance without having to insert or withdraw cash from machines on which games of chance are played.

BACKGROUND

Cashless transaction systems are required for some gaming applications. In addition, the applicant has discovered that gaming players often desire a simple, familiar method of transferring funds in and out of gaming devices or game-of-chance terminals without inserting or withdrawing cash at the gaming devices or terminals themselves. The applicant has also discovered that game players often desire anonymity and that players often desire a spontaneous ability to convert cash to game play credits.

Most cashless systems in the prior art require a player to establish a player account at a cashier's desk or terminal. However, the requirement to establish an account in this fashion often causes undesirable and disconcerting delays in, among other things, commencement of a game of chance. This account establishment requirement also reduces the ability of the player to remain anonymous. Since many players would prefer to remain anonymous, the account establishment requirement can significantly diminish the attractiveness of playing games of chance on gaming systems or devices that are subject to such a requirement.

Although other prior art systems have also provided the player with the ability to transfer funds from gaming device to gaming device via a printed voucher, they typically have required that the player insert cash funds into a gaming device—an apparatus on which the player actually plays or can play a game of chance—to initiate game credit deposits. This is unworkable in certain jurisdictions as well as less than optimal for players who prefer not to deal with insertion of funds at the gaming devices or transfer of funds (such as heavy or voluminous cups of coins) from one game of chance to another or from a game of chance to a cashier in order to cash in the awarded coins for cash or other credit.

SUMMARY OF THE INVENTION

The applicant has invented a gaming system and method for a game player to play a game of chance without ever having to insert or withdraw cash at the gaming devices themselves. The player provides input remuneration, such as cash, to a cash exchange terminal. The player receives a cashless voucher from the cash exchange terminal, and the cashless voucher has indicia on it indicating the value of the cashless voucher. The player takes the voucher to a gaming device and inserts the cashless voucher into the gaming device in order to establish credit at the gaming device and initiate play on the gaming device. Upon termination of play at the gaming device, the player receives a new the cashless voucher if the player has a credit or award balance due to the player at the time of termination of play. The new cashless voucher has indicia reflecting any such credit or award balance awarded.

Preferably, the player may then exchange the new cashless voucher for remuneration or an award based on the credit or award balance indicated on the voucher. This exchange preferably takes place at the cash exchange terminal.

Preferably, the player may alternatively utilize the new cashless voucher to commence play at a second gaming device. In the event that play terminates at this second gaming device with yet another credit or award balance remaining for the player at the second gaming device, the second gaming device preferably issues yet another new cashless voucher to the player reflecting such credit or award balance for the player at the second gaming device.

Preferably, the gaming devices and cash exchange terminal are interconnected on a communications network, such as a LAN. Preferably, the various indicia printed on the various vouchers are encrypted according to a security algorithm.

There are other aspects of the present invention. They will become apparent as this specification proceeds.

BRIEF DESCRIPTION OF THE DRAWINGS

The preferred and other embodiments of the present invention are shown in the accompanying drawings wherein.

DETAILED DESCRIPTION OF THE PREFERRED EMBODIMENT

Figure 1:
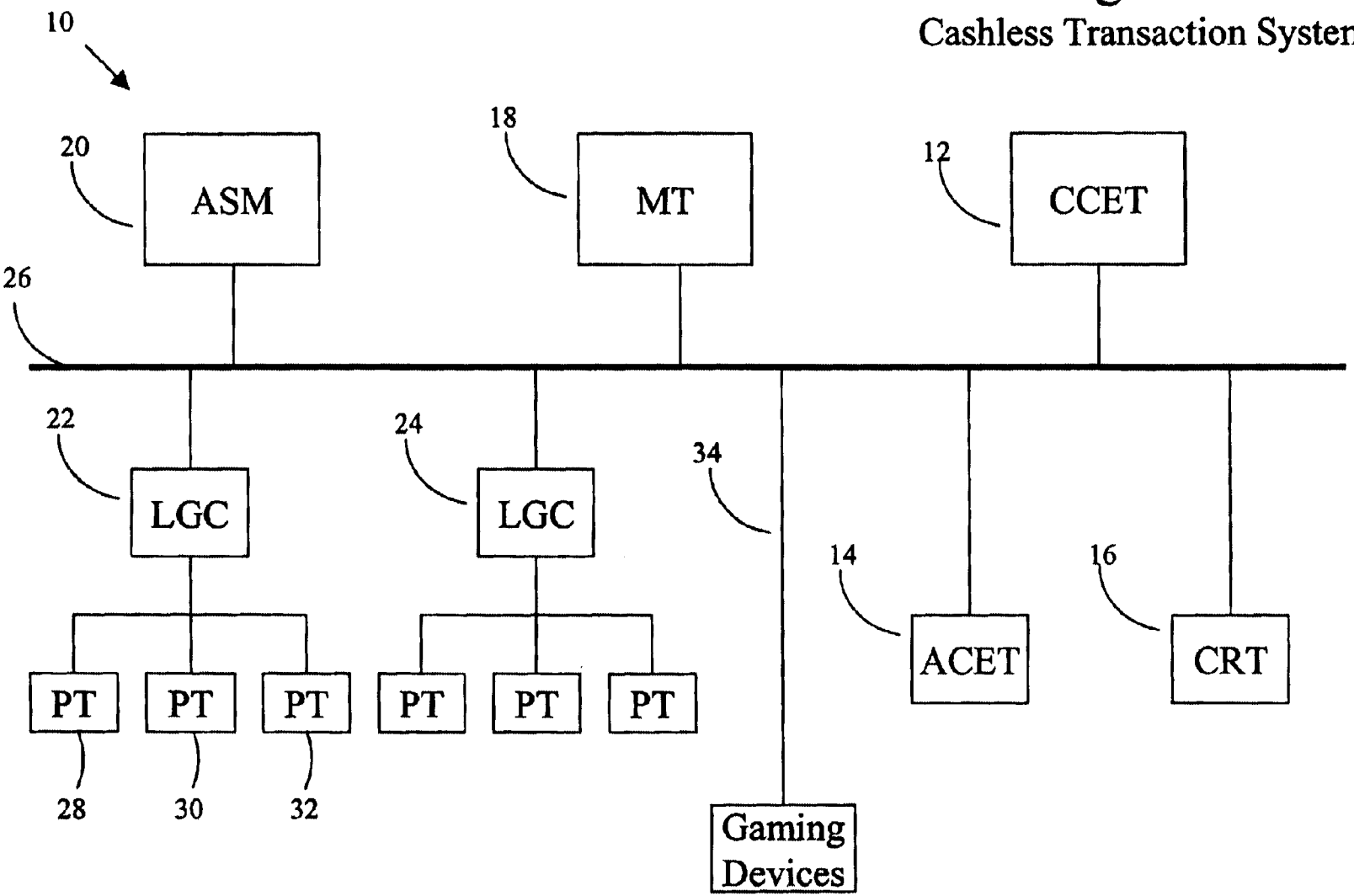
FIG. 1 is a block diagram of the applicant's preferred cashless gaming system network for use in practicing the applicant's preferred method.

With reference now to FIG. 1, the applicant's preferred cashless gaming system, generally 10, has a central cash exchange terminal ("CCET" 12, an automated cash exchange terminal ("ACET") 14, an automated cash redemption terminal ("CRT") 16, a monitor terminal ("MT") 18, an account server manager PC workstation ("ASM") 20, and two lottery or logical game controllers ("LGC") 22, 24 all interconnected and Ethernet LAN 26, and player terminals ("PT"), e.g., 28, 30, 32, are connected to their respective LGC's, e.g., 22, on the LAN 26 in a fashion well known in the art. The LAN 26 may also be connected 34 to a variety of other LGC's (not shown) in a fashion well known in the art. The monitor terminal 18 and ASM 20 consist of personal computers that respectively run monitoring and database software on the LAN 26 in a fashion described herein and otherwise well known to those skilled in the art.

Figure 2:
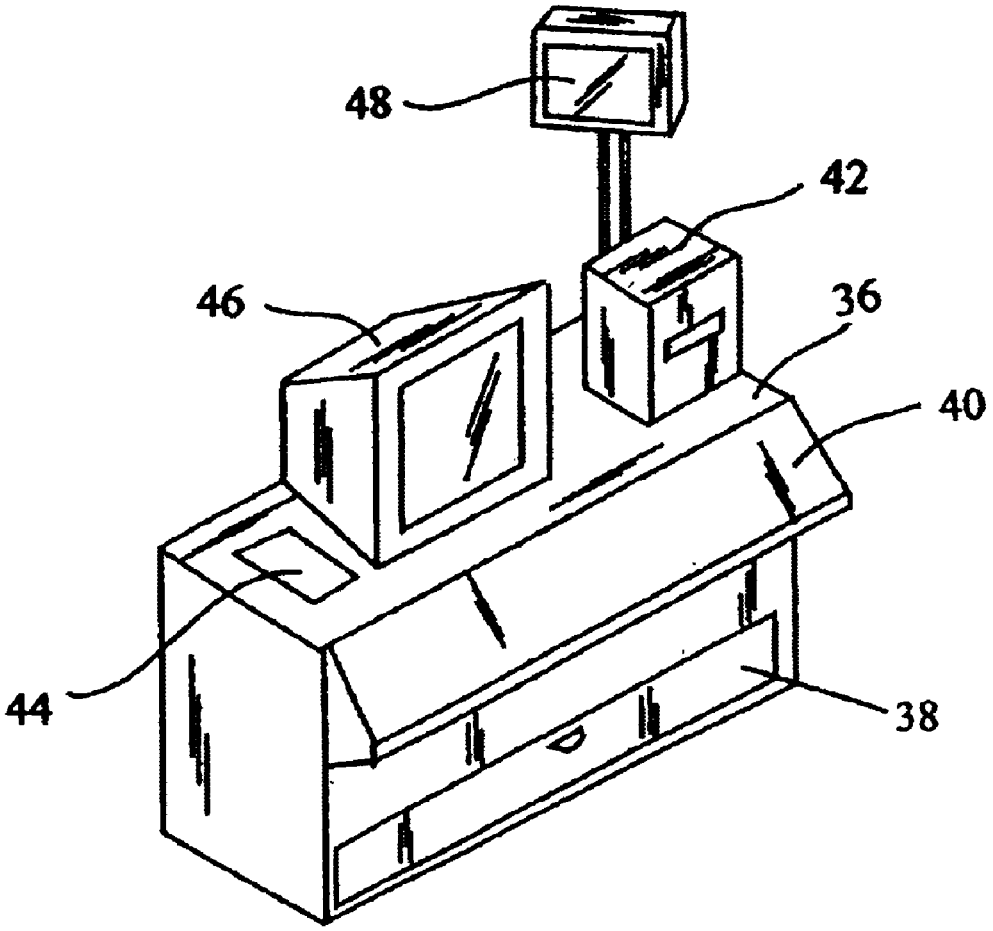
FIG. 2 is a pictorial view of a central cash exchange terminal for use in the applicant's cashless gaming system of FIG. 1.
Figure 3:
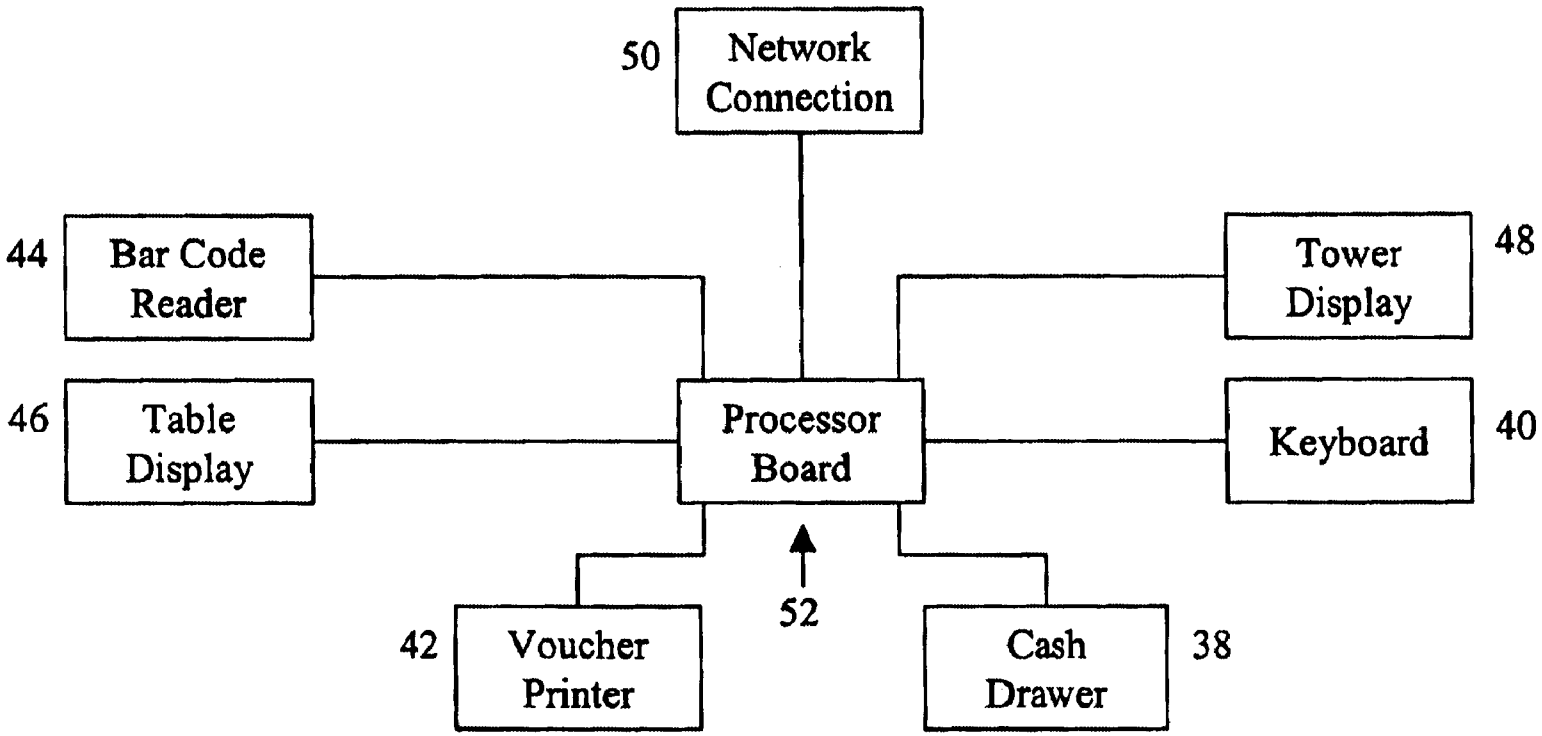
FIG. 3 is block diagram of the central cash exchange terminal of FIG. 2.

With reference now to FIG. 2, the CCET 12 has a terminal frame 36 with a personal computer motherboard (not shown in FIG. 2) mounted within the frame 36. Also mounted on the periphery of the frame 36 are a cash and voucher drawer 38, an input keyboard 40, a voucher printer 42, a voucher bar code reader 44, network comm. ports 50 (not shown in FIG. 2), a cashier video display 46, and a player or customer video display 48. With reference now to FIG. 3, the personal computer motherboard 52 mounted within the CCET 12 of FIG. 2 has input/output ports driving and supporting the bar code reader 44, the cashier or table display 46, the voucher printer 42, the cash drawer 38, the keyboard 40, the customer or tower display 48, and the conventional comm ports 50 connected to the LAN 26 of FIG. 1. The CCET 12 may also have a receipt printer arranged to operate in association with CCET 12 in a fashion well known to those skilled in the art.

Referring back to FIG. 2, a cashier ("not shown") who operates the CCET 12 can receive cash (not shown) from a game player (not shown), enter information about the transaction into the CCET 12 through keyboard 40, procure a printed voucher (not shown) from the voucher printer 42, and hand the printed voucher to the game player. In one preferred embodiment the printed voucher has a bar code that includes information about the transaction encoded and embedded within the bar code including a unique transaction identifier or unique transaction identification (identifier and identification reference the same ID). A transaction identifier can be based on a unique random number generated by a random number generator running in the ASM 20 of FIG. 1. A transaction identifier may also be based on time combined with one or more of a date or a machine identifier or may be based on other information or source of unique numbers, then encrypted by the ASM 20 or by the CCET 12 and included by the CCET 12 in the bar code printed on the voucher by the voucher printer 42.

The cashier may also receive a voucher from the player, scan and thereby retrieve information from the voucher with the bar code reader 44, deposit the voucher in the drawer 38, and procure from the drawer 38 the cash balance stated for the voucher on the video displays 46, 48. The cashier may then dispense the cash thus procured from the drawer 38 to the player, and the player may confirm the amount due to the player by viewing transaction data shown on the customer video display 48.

Figure 4:
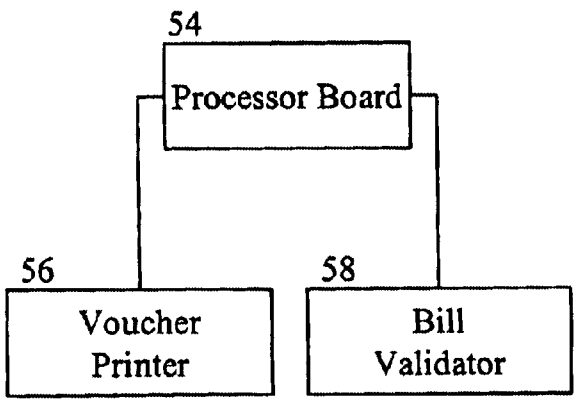
FIG. 4 is a block diagram of a peripheral, automated cash exchange terminal for use in the applicant's cashless gaming system of FIG. 1.
Figure 6:
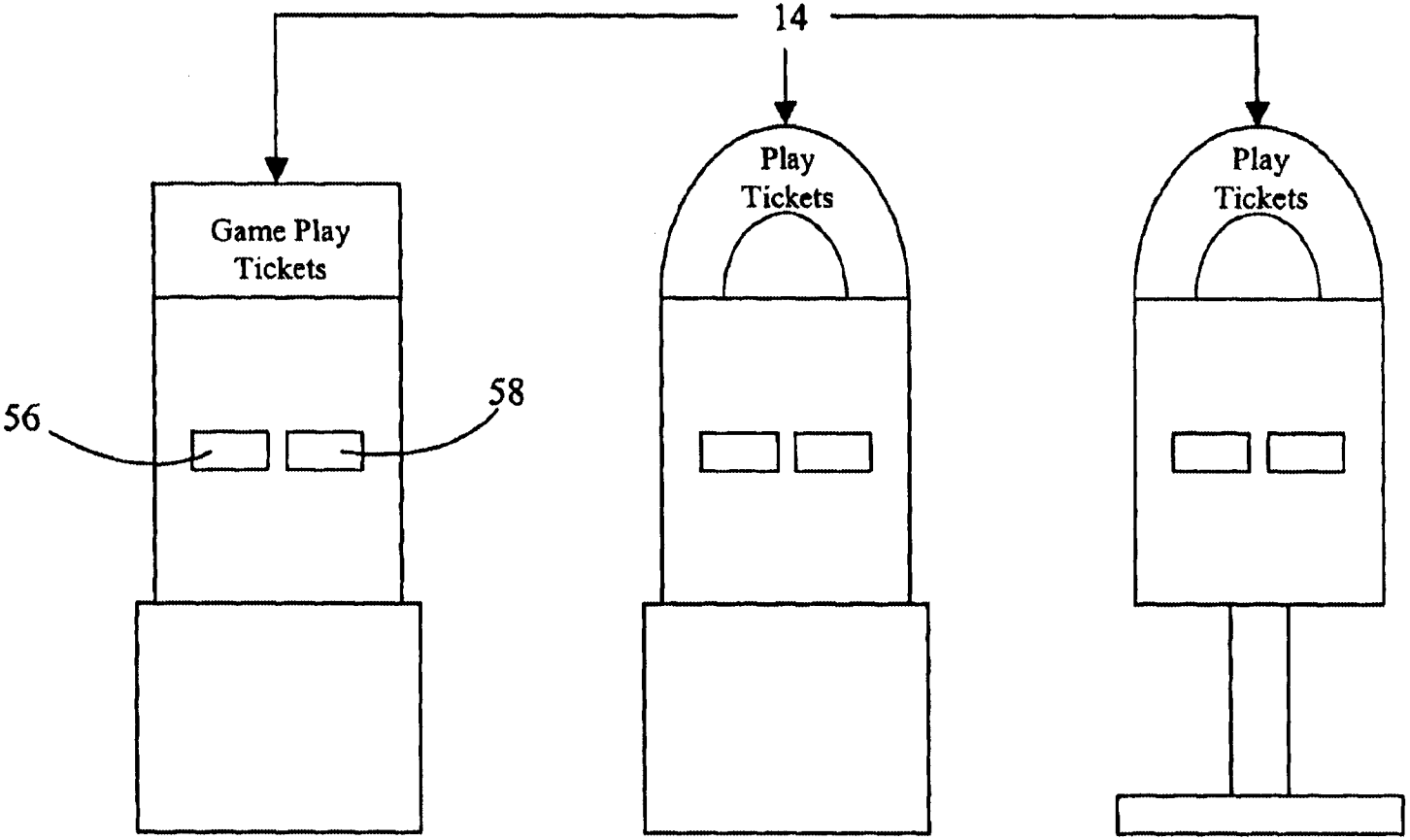
FIG. 6 is a pictorial view of various alternative embodiments of peripheral cash exchange terminals for use in the applicant's cashless gaming system of FIG. 1.

With reference now to FIG. 4, the ACET 14 has a PC processor board 54 with input/output ports driving and supporting a voucher printer 56 and bill validator 58 and with conventional comm ports 60 connected to the LAN 26 of FIG. 1. As shown in FIG. 6, the preferred system and method may employ a bank of ACETs 14, and the ACETs may have a variety of external shapes. The game player may thus insert cash, expeditiously and with no human interaction, into the bill validator 58, and if the bill is validated the voucher printer 56 prints and dispenses to the player a voucher having a bar code or other machine readable indicia printed thereon, the bar code (or other machine readable indicia having the same contents) containing a transaction identifier usable for finding an associated value, and optionally having indicia representing the value embedded within it.

Figure 5:
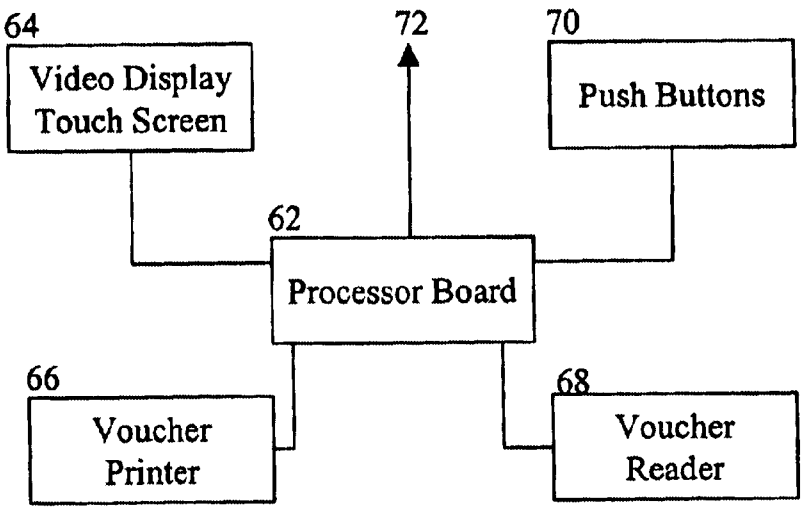
FIG. 5 is a block diagram of a player gaming device or terminal for use in the applicant's cashless gaming system of FIG. 1.

With reference now to FIG. 5, each PT, e.g., 28, has a personal computer processor board 62 and input/output ports driving and supporting a game video display and touch screen 64, a voucher printer 66, a voucher reader 68, game controlling push buttons 70, and conventional network comm ports 72. The game player may thus insert a voucher into the voucher reader 68, which, if needed or desired, decrypts the voucher and if the credit balance on the voucher is sufficient, authorize the player to initiate game play through the display and touch screen 64 and push buttons 70. This authorization may take place in cooperation with verification and/or confirmation of the voucher data, or coupled with the retrieval of a value associated with the voucher, via the ASM 20 of FIG. 1, in the same fashion as is described below for such verification by the ACET 14.

Referring back to FIG. 5, when the player terminates play by pushing appropriate conventional buttons 70 on the PT 28, the processor board 62 is programmed to drive the voucher printer 66 to issue another voucher to the player. The new voucher has a bar code printed thereon by the printer 66, and this bar code includes information about, or a pointer to, the credit or award balance due to the player on termination of play on the PT. The PT 28 also generates and sends the transaction identification and value information to the ASM 20 of FIG. 1, and the ASM 20 records and stores this information in a database maintained on the ASM 20 as noted above.

Alternatively, the PT 28 may include conventional cash bins and hoppers, and the processor board 62 may be programmed to provide the player with an option, via the touch screen 64, to elect to receive an award in cash in the hopper at the PT 28. In this event, the PT 28 may issue a cash award rather than the voucher noted above to the player, and this cash award event may be structured as is well known in the art to generate noise and excitement in the gaming establishment.

Figure 8:
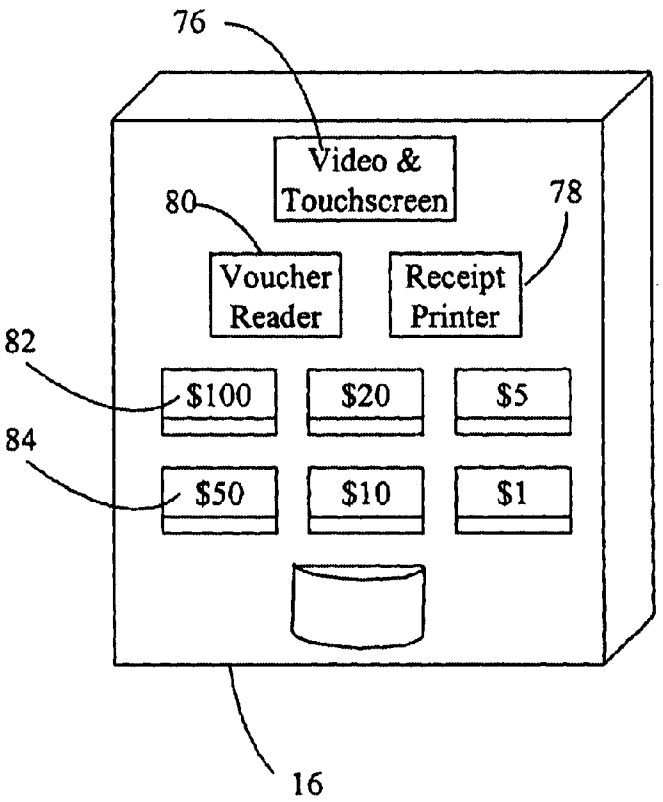
FIG. 8 is a pictorial view of the cash redemption terminal of FIG. 7.
Figure 7:
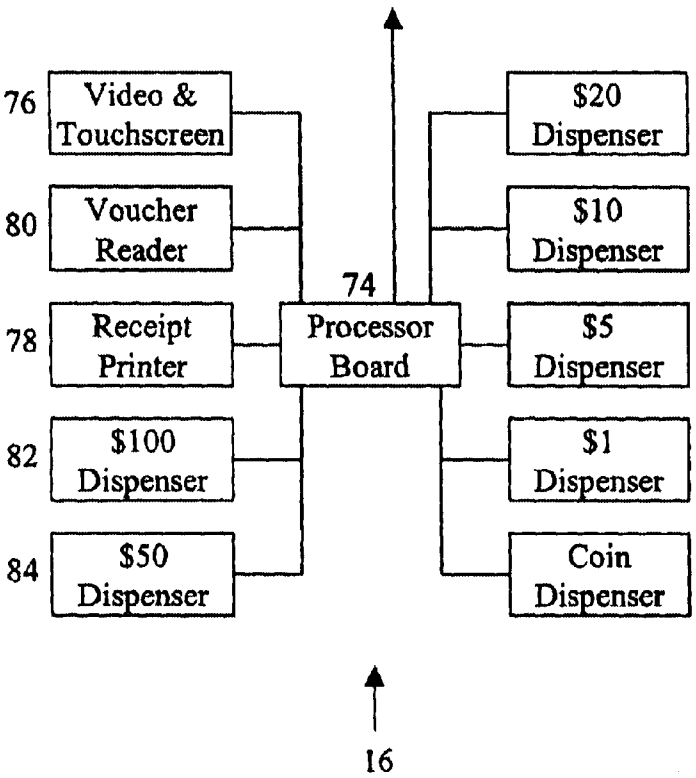
FIG. 7 is a block diagram of a cash redemption terminal for use in the applicant's cashless gaming system of FIG. 1.

With reference now to FIG. 7, the CRT 16 has a personal computer processor board 74 with input/output ports supporting and driving a video display touch screen 76, a receipt printer 78, a voucher reader 80, and a variety of cash dispensers of differing yet common cash denominations 82, 84. CRT 16 is further shown in FIG. 8, with the described components embodied in an enclosure. The above-referenced components are programmed and driven so that, upon the insertion of a voucher into the voucher reader 80, the voucher reader 80 decrypts information on the voucher, and then verifies through communication with the ASM20, the voucher information and confirms or establishes the worth or value associated with the voucher. The display touch screen 76 then displays the amount shown on the voucher and presents the voucher-bearer with the choice of types of cash denominations in which to receive the value in cash from the CRT 16. When the voucher-bearer touches the selected denomination and the value of the inserted voucher includes enough of a balance to issue such a denomination, the selected denomination issues from the appropriate cash dispenser, e.g. 82, 84, on the CRT 16. The CRT 16 automatically issues any lesser balance owed to the player in automatically determined cash dispensers from the appropriate lesser denominations. The receipt printer 80 on the CRT 16 also issues a receipt to the voucher-bearer, and the CRT 16 retains the voucher.

Figure 9:
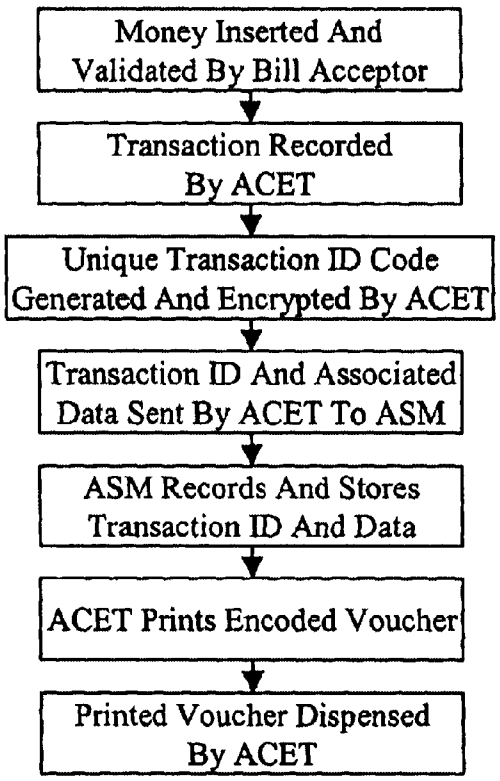
FIG. 9 is a flow chart of the applicant's method of use of the automated cash exchange terminal(s) to procure a voucher with the applicant's system of FIG. 1.

With reference now to FIGS. 1 and 9, one alternative for procuring a voucher in order to commence cashless gaming is for the player to insert money in to a bill acceptor I the ACET 14. The ACET 14 generates and encrypts a unique transaction identifier according to any of a number of encryption techniques well known to those skilled in the art. The ACET 14 then sends the transaction identifier and associated data, such as the amount of money inserted into the bill acceptor, to the ASM 20. The ASM 20 records and stores the transaction identifier and associated data. The ACET 14 then prints a voucher with a bar code containing the transaction identifier and associated data. The ACET 14 then dispenses the voucher to the player.

Figure 10:
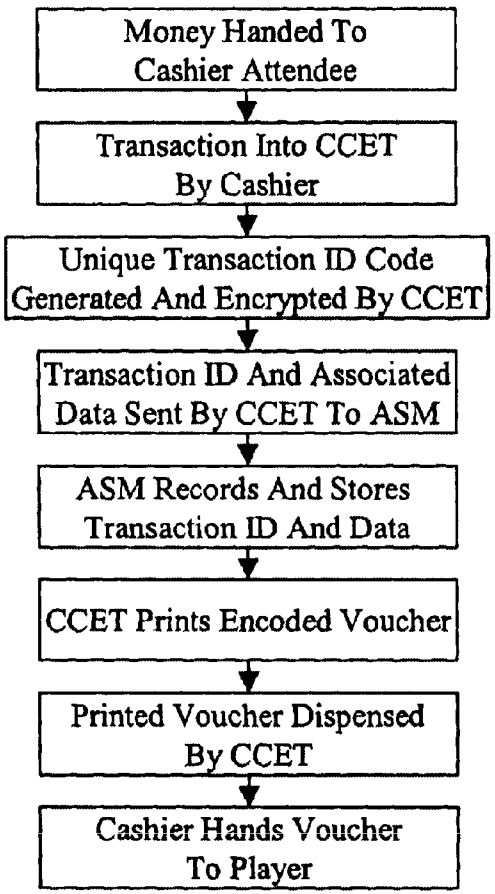
FIG. 10 is a flow chart of the applicant's method of use of the central cash exchange terminal to procure a voucher with the applicant's system of FIG. 1.

With reference now to FIGS. 1 and 10, another method of procuring a voucher is through the CCET 12 of FIG. 1. The player hands money to the cashier, and the cashier then enters the value of the transaction into the CCET 12. As shown in FIG. 2, the value entered is shown on the video displays 46, 48, so that the cashier and player may see the value of the transaction as it is entered by the cashier into the system. With reference back to FIGS. 1 and 10, the CCET 12 generates and encrypts a unique transaction identifier according to any of a number of encryption techniques well known to those skilled in the art. The CCET 12 then sends the transaction identifier and associated data, such as the amount of money inserted into the bill acceptor, to the ASM 20. The ASM 20 records and stores the transaction identifier and associated data. The CCET 12 then prints a voucher with a bar code containing the transaction identifier and/or associated data. The CCET 12 then dispenses the voucher to the cashier, and the cashier then hands the voucher to the player. The issuance of the voucher is confirmed on the video displays 46, 48 as shown in FIG. 2.

Figure 11:
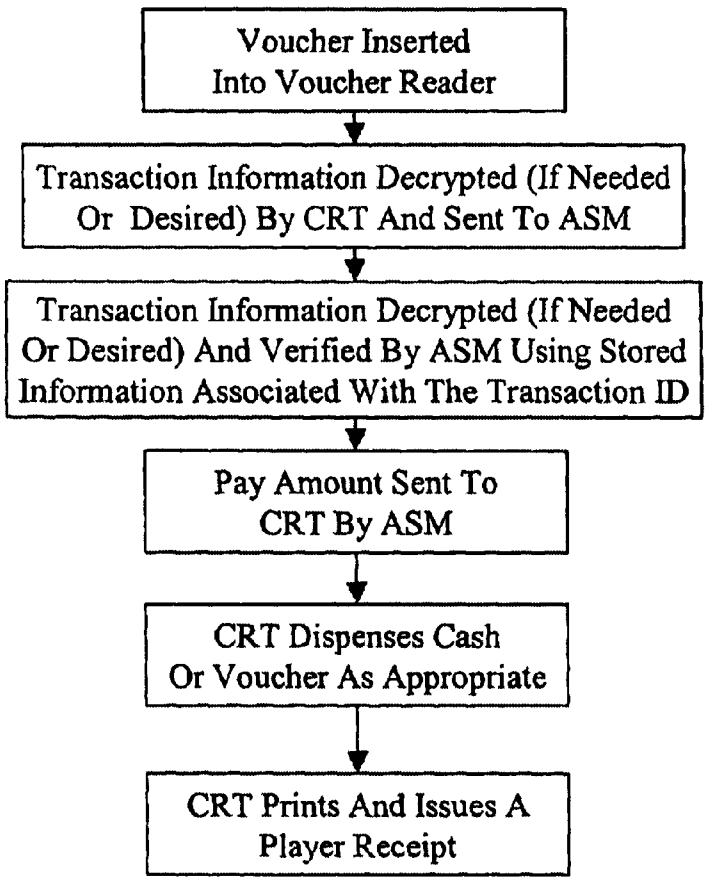
FIG. 11 is a flow chart of the applicant's method of use of the automated cash redemption terminal(s) to exchange a voucher for cash and/or another voucher with the applicant's preferred system of FIG. 1.

With reference now to FIGS. 1 and 11, a player may cash in a voucher by inserting the voucher into a voucher reader (68 in FIG. 5) at the CRT 16. The CRT 16 decrypts, if needed or desired, the information on the voucher, then sends the information to the ASM 20. The ASM 20 then decrypts, if needed, the information from the voucher and then as needed may find and/or verify and/or confirm a value associated with this voucher. If the ASM 20 determines that the voucher is invalid (i.e., cannot confirm validity), the ASM 20 sends an instruction to the CRT 16 to reject the voucher.

If the ASM 20 confirms that the voucher is valid, it sends the verified value to the CRT. The CRT 16 then, through its touch screen and display (64 in FIG. 5), asks the player to make a selection of cash or a voucher for later use by the player at, for example, a later date or visit by the player to the gaming establishment. After the player makes his or her selection through the touch screen, the CRT 16 issues cash or a voucher, and a receipt, according to the selection made by the player.

Figure 12:
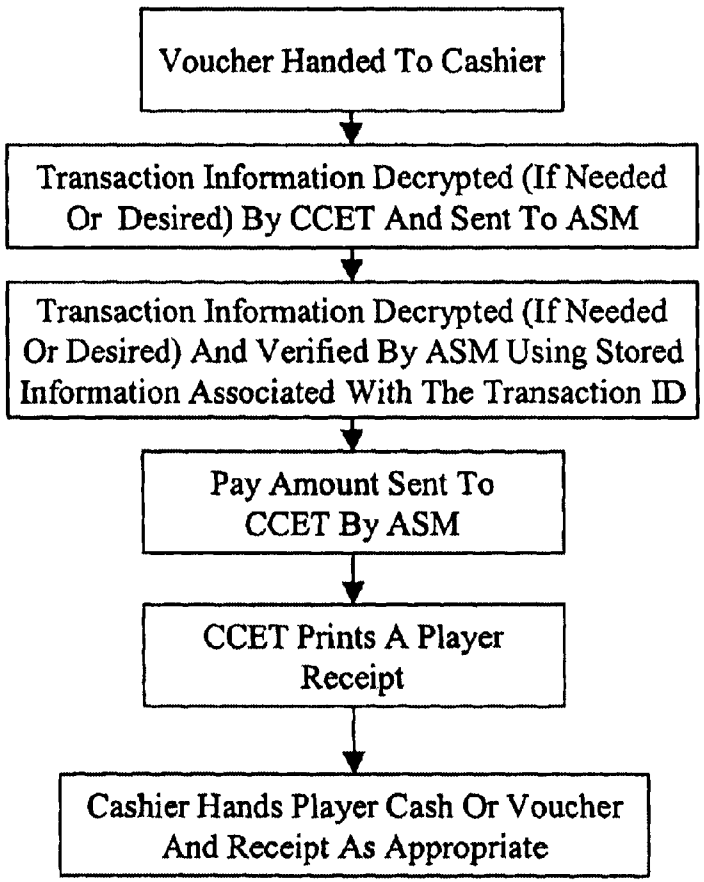
FIG. 12 is a flow chart of the applicant's method of use of the central cash exchange terminal to exchange a voucher for cash and/or another voucher with the applicant's preferred system of FIG. 1.

With reference now to FIGS. 1 and 12, a player may alternatively cash in a voucher by handing the voucher to a cashier at the CCET 12. The CCET 12 decrypts, if needed or desired, the information on the voucher, then send the information to the ASM 20. The ASM 20 then decrypts, if needed, the information from the voucher and then as needed may find and/or verify and/or confirm a value associated with this voucher. If the ASM 20 determines that the voucher is invalid (i.e., cannot confirm validity), the ASM 20 sends an instruction to the cashier at the CCET 12 to reject the voucher.

If the ASM 20 confirms that the voucher is valid, it sends the verified value to the CCET 12 and displays the value on the two CCET display screens (46, 48). The cashier then asks the player to make a selection of cash or a voucher for later use by the player at, for example, a later date or visit by the player to the gaming establishment. After the player states his or her selection to the cashier, the cashier issues cash or procures the issuance of a voucher, and a receipt, according to instructions entered by the cashier through the CCET keyboard 40 as shown in FIG. 2. The cashier also inserts the voucher received from the player into the cash and voucher drawer 38.

It can thus be seen that the preferred embodiments described above provide a method and system for cashless playing of games of chance. The player need not carry cash from place to place in the gaming establishment and need not even deal with a cashier. The player also may leave the gaming establishment and return to play another day without having to carry cash to and from the establishment at least to the extent of a voucher issued to the player at the termination of game play. In this latter embodiment, the player thus has an incentive to return to utilize or cash in the voucher received upon prior departure from the establishment. There are other advantages that variously flow from the invention and various alternatives and embodiments noted above.

It is to be understood that the foregoing is a detailed description of the preferred embodiment. The scope of the invention, however, is to be determined by reference to the following claims.

What is claimed is:

1. A gaming system for a player to play a game of chance, the gaming system comprising:

(A) a communication network, the communication network being adapted to facilitate communication between devices in communication with the network;

(B) an exchange terminal in communication with the communication network, the exchange terminal including a voucher printer, the voucher printer being adapted to issue a cashless voucher to the player, the cashless voucher including indicia indicating a transaction identification and the transaction identification being generated by the exchange terminal, the transaction identification comprising at least a time derived value, wherein a value of the cashless voucher may be retrieved using the transaction identification and the exchange terminal sends the transaction identification and the associated value of the cashless voucher to a server;

(C) a plurality of player terminals in communication with the communication network, each player terminal including:

(a) a voucher reader, the voucher reader being adapted to read indicia on the cashless voucher; and (b) a game interface, the game interface being adapted to allow the player to play at least one game;

wherein each player terminal is adapted to determine the transaction identification of the cashless voucher from the indicia on the cashless voucher and retrieve the value of the cashless voucher using the transaction identification; and (D) a database connected to the server on the gaming system in communication with the communication network adapted to maintain an association between each transaction identification and a value.

2. The gaming system of claim 1 also comprising a money redemption terminal in communication with the communication network, the money redemption terminal having a voucher reader, the voucher reader being adapted to read the indicia on the cashless voucher, wherein the money redemption terminal is adapted to determine the transaction identification from the indicia, retrieve the value of the cashless voucher using the transaction identification, and issue money or awards based on the value of the cashless voucher.

3. The gaming system of claim 1 wherein the exchange terminal further includes a voucher reader adapted to read indicia on the cashless voucher, wherein the exchange terminal is adapted to determine the transaction identification from the indicia, retrieve the value of the cashless voucher using the transaction identification, and authorize issuance of money or awards based on the value of the cashless voucher.

4. The gaming system of claim 1 wherein the transaction identification is at least partially encrypted.

5. The gaming system of claim 1 wherein each of the player terminals is not adapted to accept cash from the player.

6. A method of operating a gaming system, the method comprising:

(A) accepting remuneration from a player;

(B) generating a unique transaction identification comprising at least a time derived value, the generating being done in a player terminal or an exchange terminal;

(C) associating the transaction identification with a value of a cashless voucher;

(D) sending the transaction identification and the associated value of the cashless voucher to a server for updating of a database on the server;

(E) printing indicia on the cashless voucher, the indicia indicating the transaction identification;

(F) issuing the cashless voucher to the player;

(G) receiving the cashless voucher from the player at a player terminal;

(H) reading the indicia on the cashless voucher;

(I) determining the transaction identification from the indicia;

(J) retrieving the value of the cashless voucher using the transaction identification; and (K) crediting the value of the cashless voucher on the player terminal for play of the game by the player.

7. The method of claim 6 further comprising not accepting cash from the player at the player terminal.

8. The method of claim 6 wherein the indicia is at least partially encrypted.

9. A method of operating a gaming system, the method comprising:

(A) accepting remuneration from a player, the remuneration not being accepted at a player terminal;

(B) generating a unique transaction identification comprising at least a time derived value, the generating being done in the player terminal or in an exchange terminal;

(C) associating the transaction identification with a value of a cashless voucher;

(D) sending the transaction identification and the associated value of the cashless voucher to a server for updating a database on the server;

(E) printing indicia on the cashless voucher, the indicia indicating the transaction identification;

(F) issuing the cashless voucher to the player;

(G) receiving the cashless voucher from the player at a player terminal;

(H) reading the indicia on the cashless voucher;

(I) determining the transaction identification from the indicia;

(J) retrieving the value of the cashless voucher using the transaction identification; and (K) issuing cash to the player based on the value of the cashless voucher.

10. The method of claim 9 wherein the indicia is at least partially encrypted.

11. A gaming system for a player to play a game of chance, the gaming system comprising:

(A) a communication network, the communication network being adapted to facilitate communication between devices in communication with the network;

(B) an exchange terminal in communication with the communication network, the exchange terminal including a voucher printer, the voucher printer being adapted to issue a cashless voucher to the player, the cashless voucher including indicia indicating a transaction identification and the transaction identifier being generated by the exchange terminal, the transaction identification comprising at least a time derived value, wherein a value of the cashless voucher may be retrieved using the transaction identification and the exchange terminal sends the transaction identification and the associated value of the cashless voucher to a server;

(C) a redemption terminal in communication with the communication network, the redemption terminal including:

(a) a voucher reader, the voucher reader being adapted to read indicia on the cashless voucher;

(b) a cash dispenser, the cash dispenser being adapted to dispense cash to the player, wherein the redemption terminal is adapted to determine the transaction identification of the cashless voucher from the indicia on the cashless voucher and retrieve the value of the cashless voucher using the transaction identification and is adapted to dispense cash based on the value of the cashless voucher; and (D) a database connected to the server on the gaming system in communication with the communication network adapted to maintain an association between each transaction identification and a value.

12. The gaming system of claim 11 wherein the cash dispenser of the redemption terminal is adapted to allow the player to select the denominations in which the cash will be dispensed.

* * * * *